US005079212A

United States Patent [19]

Ishida et al.

[11] Patent Number: 5,079,212

[45] Date of Patent: Jan. 7, 1992

[54] HEAT-SENSITIVE RECORDING MATERIAL

[75] Inventors: Koichi Ishida; Katsuaki Yoshizawa, both of Amagasaki; Yukio Takayama, Toyonaka, all of Japan

[73] Assignee: Kanzaki Paper Manufacturing Co., Ltd., Tokyo, Japan

[21] Appl. No.: 569,907

[22] Filed: Aug. 20, 1990

[30] Foreign Application Priority Data

Aug. 23, 1989 [JP] Japan ..... 1-216824

[51] Int. Cl.[5] ..... B41M 5/40

[52] U.S. Cl. ..... 503/226; 427/152; 503/200

[58] Field of Search ..... 427/152; 503/200, 226

[56] References Cited

U.S. PATENT DOCUMENTS 4,370,370 1/1983 Iwata et al. ..... 428/913

4,513,301 4/1985 Takayama et al. ..... 428/913

*Primary Examiner*—Pamela R. Schwartz

*Attorney, Agent, or Firm*—Larson and Taylor

[57] ABSTRACT

Disclosed is a heat-sensitive recording material comprising:

(a) a base sheet;

(b) a heat-sensitive recording layer formed on the base sheet land comprising a colorless or pale-colored basic dye and a color developing material which develops a color on contact with the dye; and (c) a protective layer formed on the recording layer and comprising a binder and at least one metal salt selected from the group consisting of magnesium acetate, calcium acetate, aluminum acetate, magnesium formate, calcium formate and aluminum formate.

12 Claims, No Drawings

HEAT-SENSITIVE RECORDING MATERIAL

BACKGROUND OF THE INVENTION

The present invention relates to heat-sensitive recording materials and more particularly to heat-sensitive recording materials capable of retaining record images with a high stability.

Heat-sensitive recording materials are well known which make use of the color forming reaction of a colorless or pale-colored basic dye with an organic or inorganic color developing material which develops a color on contact with the dye, such that the two materials are brought into contact with each other by heating to produce a color image. Since the above heat-sensitive recording materials are relatively inexpensive and record images are formed thereon with use of a compact printing device with an easy maintenance, the recording materials are not only used as recording media for a facsimile, various calculators or the like but also used for other various purposes.

For example, such heat-sensitive recording materials are being used as heat-sensitive labels increasingly with the development of POS system (POS=point of sales) for retailers.

If the POS system is introduced into a supermarket and the like, such heat-sensitive labels used are frequently brought into contact with water, wrap films (and plasticizers contained therein), oils and the like with the result that the record images on the labels would be reduced in color density on contact therewith. To obviate this problem, it is desired to provide heat-sensitive recording materials having sufficient resistance to water, plasticizers, oils and the like.

To improve the ability of recording materials to retain record images, proposed are a method of coating a heat-sensitive recording layer with an aqueous emulsion of a resin having a film-forming property and resistance to chemical substances (Japanese Unexamined Patent Publication No. 128347/1979), a method of coating a heat-sensitive recording layer with a water-soluble high-molecular weight compound such as polyvinyl alcohol (U.S. Pat. No. 4,370,370), a method wherein a heat-sensitive recording layer is covered with a protective layer predominantly containing carboxyl group-modified polyvinyl alcohol and then treated with a metal ion solution (Japanese Examined Patent Publication No. 39078/1983), etc. However, the proposed methods accompany new defects together with the improvements and satisfactory effects are not invariably obtained.

For example, in case a coating of an aqueous emulsion of a resin or water-soluble high-molecular weight compound or like binder is formed over a heat-sensitive recording layer, it is necessary to limit the drying temperature to avoid undesirable color formation (fogging) on the recording layer due to drying at high temperatures. However, the drying at limited temperatures would lead to insufficient curing of the binder and consequent adhesion of the resulting protective layer to the recording head (hereinafter referred to as "sticking"). Further the recording material would be impaired in the ability to retain record images.

It is possible to accelerate the curing of the binder using an aqueous solution of a metal salt such as aluminum chloride or sulfate, as proposed in Japanese Examined Patent Publication No. 39078/1983. The proposed method, however, lowers the whiteness of heat-sensitive recording material, thereby deteriorating the commercial value thereof.

SUMMARY OF THE INVENTION

In the above situation, we conducted extensive research on protective layers formed over the recording layers of recording materials to develop heat-sensitive recording materials having high degree of whiteness, capable of retaining record images with a high stability and free from sticking and adhesion of the residue to the recording head. Our research has revealed that when a specific metal salt is incorporated into the protective layer, the obtained heat-sensitive recording material is free from the reduction of whiteness and from sticking and adhesion of the residue to the recording head and is improved in the ability to retain record images with a high stability, especially in resistance to water, plasticizers, etc. We have accomplished the present invention based on this novel finding.

DETAILED DESCRIPTION OF THE INVENTION

The present invention provides a heat-sensitive recording material comprising:

(a) a base sheet;

(b) a heat-sensitive recording layer formed on the base sheet and comprising a colorless or pale-colored basic dye and a color developing material which develops a color on contact with the dye; and (c) a protective layer formed on the recording layer and comprising a binder and at least one of magnesium salt, calcium salt and aluminum salt of acetic acid and formic acid.

According to the invention, at least one member of magnesium acetate, calcium acetate, aluminum acetate, magnesium formate, calcium formate and aluminum formate present in the protective layer serves to accelerate the curing of the binder without reduction of whiteness, and consequently to improve the ability to retain record images stably, especially the resistance to water and plasticizers, while maintaining excellent suitability for recording, i.e., freedom from sticking or from adhesion of the residue. These specific metal salts are unlikely to adversely affect the recording head, hence also desirable in this respect.

Binders to be used in the protective layer of the invention are not specifically limited and include, for example, starches, hydroxyethyl cellulose, methyl cellulose, carboxymethyl cellulose, gelatin, casein, gum arabic, polyvinyl alcohol, carboxyl group-modified polyvinyl alcohol, acetoacetyl group-modified polyvinyl alcohol, silicon-modified polyvinyl alcohol, salts of diisobutylene-maleic anhydride copolymer, salts of styrene-maleic anhydride copolymer, salts of ethylene-acrylic acid copolymer, or salts of styrene-acrylic acid copolymer, and like water-soluble high-molecular weight substances, etc. These binders are usable singly or at least two of them can be used in mixture. Among them, polyvinyl alcohols, and modified polyvinyl alcohols, especially carboxyl group-modified polyvinyl alcohol, acetoacetyl group-modified polyvinyl alcohol and silicon-modified polyvinyl alcohol are preferred because excellent effects are obtained when they are used in combination with at least one of the above-specified metal salts.

Such polyvinyl alcohols e.g. polyvinyl alcohol, carboxyl group-modified polyvinyl alcohol, acetoacetyl group-modified polyvinyl alcohol and silicon-modified polyvinyl alcohol typically have a saponification degree of at least about 65 mole %, preferably about 80 to 100 mole %, and a polymerization degree of at least about 200, preferably about 500 to about 3500.

Examples of the carboxyl group-modified polyvinyl alcohols include reaction products obtained by reacting polyvinyl alcohol with a carboxylic acid or anhydride thereof such as fumaric acid, maleic acid, itaconic acid, maleic anhydride, phthalic anhydride, trimellitic anhydride, itaconic anhydride and the like, or esters prepared by esterifying such reaction products, and further include those prepared by saponifying a copolymer of vinyl acetate and an ethylenically unsaturated carboxylic acid such as maleic acid, fumaric acid and itaconic acid. It is preferable that such carboxyl group-modified polyvinyl alcohols contain carboxylic acid- or carboxylic acid anhydride-modified vinyl alcohol units which may be esterified or ethylenically unsaturated carboxylic acid units in an amount of about 0.1 to about 20 mole %, preferably about 0.5 to about 10 mole %.

Examples of acetoacetyl group-modified polyvinyl alcohols are those prepared by reacting polyvinyl alcohol in the form of a solution, dispersion or powder with a liquid- or gas-form diketene to effect acetoacetylation. It is preferable that the content of such acetoacetylated vinyl alcohol units within a molecule of acetoacetyl group-modified polyvinyl alcohol is about 0.1 to about 20 mole %, preferably about 0.5 to about 10 mole %.

Examples of silicon-modified polyvinyl alcohols are those prepared by reacting polyvinyl alcohol or modified polyvinyl acetate containing carboxyl or hydroxyl groups with a silylating agent such as trimethylchlorosilane, trimethylacetoxysilane and the like, or those prepared by saponifying a copolymer of vinyl acetate and a Si-containing olefinically unsaturated monomer such as vinylsilanes, acrylamido-alkylsilanes, methacrylamidoalkylsilanes or the like. It is preferable that the content of such silylated units or Si-containing olefinically unsaturated monomer units within a molecule of the silicon-modified polyvinyl alcohol is about 0.1 to about 20 mole %, preferably about 0.5 to about 10 mole %.

The amount of the metal salt to be used in the invention is not specifically limited, but it us usually about 0.1 to about 30 parts by weight, preferably about 0.5 to about 20 parts by weight, more preferably about 0.5 to about 10 parts by weight, per 100 parts by weight of the binder.

A curing agent can be conjointly used in the invention to further improve the resistance to water. Useful curing agents include glyoxal, formalin, glycine, glycidyl ester compounds, glycidyl ether compounds, dimethylol urea, diketene compounds, dialdehyde starch, melamine resin, polyamide resin, polyamide-epichlorohydrin resin, ketone-aldehyde resin, borax, boric acid, ammonium salt of zirconium carbonate, etc.

The amount of the curing agent to be used is not particularly limited, and may range from about 0.001 to about 100 parts by weight, preferably from about 0.1 to about 30 parts by weight, per 100 parts by weight of the binder.

When required, the protective layer may contain a pigment to further improve the suitability for printing and to further obviate the problem of sticking. Examples of useful pigments are calcium carbonate, zinc oxide, aluminum oxide, titanium dioxide, silicon dioxide, aluminum hydroxide, barium sulfate, zinc sulfate, talc, kaolin, clay, calcined kaolin, colloidal silica and like inorganic pigments; styrene microball, nylon powder, polyethylene powder, urea-formalin resin filler, raw starch powder and like organic pigments, etc.

The average particle size of the pigment to be used is suitably selected depending on the kind of pigment, coating amount of the protective layer and the like, and usually ranges from about 0.1 to about 10 μm.

The amount of the pigment to be used is not specifically limited, but generally in the range of about 5 to about 1000 parts by weight, preferably about 50 to about 500 parts by weight, per 100 parts by weight of the binder.

The above components are usually formulated into a coating composition for forming the protective layer. There is no specific restriction on the manner of preparing such coating composition. The coating composition is usually prepared by mixing an aqueous solution of a binder with an aqueous solution of the above-specified metal salt, and if desired, a curing agent, a pigment or auxiliaries to be described below. Depending on the kinds of binder, curing agent, pigment or auxiliaries, stability of the coating composition may occasionally be impaired upon contact with a metal salt, especially when the concentration of the metal salt aqueous solution is high. Therefore, it is preferable to prevent a metal salt aqueous solution of high concentration from contacting with the other components, for example, by reducing the concentration of the metal salt aqueous solution to be added or by first separately providing a metal salt aqueous solution and an aqueous solution or aqueous dispersion of the other components and then mixing them together.

Various auxiliaries can be admixed with the coating composition for forming the protective layer, when so required. Examples of such auxiliaries are zinc stearate, calcium stearate, polyethylene wax, carnauba wax, paraffin wax, ester wax and like lubricants, sodium dioctylsulfosuccinate and like surfactants (dispersants, wetting agent, etc.), defoaming agents, etc.

The coating composition for forming the protective layer is applied to the heat-sensitive recording layer by a suitable coating method such as air knife coating, bar coating, varibar blade coating, pure blade coating, short dwell coating, curtain coating or the like. If the composition is applied in an amount of more than 20 g/m$^2$ in terms of dry weight, the heat-sensitive recording material may be significantly reduced in recording sensitivity. In view of this possibility, a suitable amount is usually about 0.1 to about 20 g/m$^2$, preferably about 0.5 to about 10 g/m$^2$ in terms of dry weight.

Basic dyes to be incorporated into the heat-sensitive recording layer in the invention include conventional colorless or pale-colored dyes. Examples of such dyes are 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, 3-p-dimethylaminophenyl-3-(1-methylpyrrol-3-yl)-6-dimethylaminophthalide and like triarylmethane-based dyes; 4,4'-bis-dimethylaminobenzhydrylbenzylether, N-halophenyl-leucoauramine, N-2,4,5-trichlorophenyl-leucoauramine and like diphenylmethane-based dyes; benzoyl-leucomethylene blue, p-nitrobenzoyl-leucomethylene blue and like thiazine-based dyes; 3-methyl-spiro-dinaphthopyrane, 3-ethyl-spiro-dinaphthopyrane, 3-phenyl-spiro-dinaphthopyrane, 3-benzyl-spiro-dinaphthopyrane, 3-methyl-naphtho-(6'-methoxybenzo)spiropyrane, 3-propyl-spiro-dibenzopyrane and like spiro-based dyes; rhodamine-B-anilinolactam, rhodamine(p-nitroanilino)lactam, rhodamine(o-chloroanilino)lactam and like lactam-based dyes; 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxy-phenylamino)fluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-diethylamino-7-(o-fluorophenylamino)fluoran, 3-dibutylamino-7-(o-fluorophenylamino)fluoran, 3-dibutylamino-6-methyl-7-phenylaminofluoran, 3-dipentylamino-6-methyl-7-phenylaminofluoran, 3-(N-methyl-N-n-amyl)amino-6-methyl-7-phenylaminofluoran, 3-(N-ethyl-N-n-amyl-)amino-6-methyl-7-phenylaminofluoran, 3-(N-ethyl-N-isoamyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-β-ethylhexyl-)amino-6-methyl-7-phenylaminofluoran and like fluoran-based dyes; etc. These basic dyes can be used singly or at least two of them can be used in mixture.

Useful color developing materials include conventional organic or inorganic acidic materials which can form a color in contact with the above basic dyes. Examples of useful inorganic acidic materials are activated clay, attapulgite, colloidal silica, aluminum silicate and the like. Examples of useful organic acidic materials are phenolic compounds such as 4-tert-butyl phenol, 4-hydroxydiphenoxide, α-naphthol, β-naphthol, 4-hydroxyacetophenol, 4-tert-octylcatechol, 2,2'-dihydroxydiphenol, 4,4'-isopropylidenebis(2-tert-butylphenol), 4,4'-sec-butylidenediphenol, 4-phenylphenol, 4,4'-isopropylidenediphenol, 2,2-bis(4-hydroxyphenyl)-4-methylpentane, 2,2'-methylenebis(4-chlorophenol), hydroquinone, 4,4'-cyclohexylidenediphenol, 4,4'-dihydroxydiphenylsulfide, hydroquinone monobenzyl ether, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolak phenol resin and phenolic polymer; aromatic carboxylic acids such as benzoic acid, p-tert-butylbenzoic acid, trichlorobenzoic acid, terephthalic acid, 3-sec-butyl-4-hydroxy-benzoic acid, 3-cyclohexyl-4-hydroxybenzoic acid, 3,5-dimethyl-4-hydroxybenzoic acid, 3-tert-butylsalicyclic acid, 3-benzylsalicyclic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)salicylic acid, 3,5-di-α-methylbenzylsalicyclic acid and the like; 4-hydroxydiphenylsulfone-derivatives such as 4,4'-dihydroxydiphenylsulfone, 4-hydroxy-4'-isopropyloxydiphenylsulfone, bis(3-allyl-4-hydroxyphenyl)sulfone, 4-hydroxy-4'-methyldiphenylsulfone, 3,4-dihydroxydiphenylsulfone, 3,4-dihydroxy-4'-methyldiphenylsulfone and the like; sulfide derivatives such as bis(3-tert-butyl-4-hydroxy-6-methylphenyl)sulfide, bis(2-methyl-4-hydroxy-6-tert-butylphenyl)sulfide and the like; salts of the above-exemplified phenolic compounds or aromatic carboxylic acids or the like with polyvalent metals such as zinc, magnesium, aluminum, calcium, titanium, manganese, tin, nickel and the like, antipyrine complex of zinc thiocyanate, etc.

The proportions of the basic dye and the color developing material to be used can be suitably determined without specific limitation according to the kinds of basic dye and color developing material. Generally the color developing material is used in an amount of about 1 to about 50 parts by weight, preferably about 2 to about 10 parts by weight, per part by weight of the basic dye.

The coating composition for forming the heat-sensitive recording layer can be prepared usually by dispersing the above components with a ball mill, sand mill or the like using water as a dispersing medium.

The coating composition may usually contain a binder such as starches, hydroxyethyl cellulose, methyl cellulose, carboxymethyl cellulose, gelatin, casein, gum arabic, polyvinyl alcohol, carboxyl group-modified polyvinyl alcohol, acetoacetyl group-modified polyvinyl alcohol, silicon-modified polyvinyl alcohol, salts of diisobutylene-maleic anhydride copolymer, salts of styrene-maleic anhydride copolymer, salts of ethylene-acrylic acid copolymer, or salts of styrene-acrylic acid copolymer; styrene-butadiene copolymer emulsion, urea resin, melamine resin, amide resin or the like. The binder is used in an amount of about 10 to about 40% by weight, preferably about 15 to about 30% by weight, based on the total solids content of the coating composition. The coating composition may further contain auxiliaries such as sodium dioctylsulfosuccinate, sodium dodecylbenzenesulfonate, sodium lauryl sulfate, metal salts of fatty acids and like dispersants, ultraviolet absorbers, defoaming agents, fluorescent dyes, coloring dyes, etc.

When required, other additives can be admixed with the coating composition. Examples of such additives are lubricants such as zinc stearate, calcium stearate, polyethylene wax, carnauba wax, paraffin wax and ester wax; and inorganic pigments such as kaolin, clay, talc, calcium carbonate, calcined kaolin, titanium oxide, diatomaceous earth, particulate anhydrous silica, activated clay and the like. A sensitizing agent may be additionally used according to the intended purpose. Examples of useful sensitizing agents are fatty acid amides such as stearic acid amide, stearic acid methylene-bisamide, oleic acid amide, palmitic acid amide and coconut fatty acid amide; hindered phenols such as 2,2'-methylenebis(4-methyl-6-tert-butylphenol), 4,4'-butylidenebis(6-tert-butyl-3-methylphenol), 2,2'-methylenebis(4-ethyl-6-tert-butylphenol) and 2,4-di-tert-butyl-3-methylphenol; 2-(2'-hydroxy-5'-methylphenyl)benzotriazole, 2-hydroxy-4-benzyloxybenzophenone, 1,2-di(3-methylphenoxy)ethane, 1,2-diphenoxyethane, 1-phenoxy-2-(4-methylphenoxy)ethane, dimethyl terephthalate, dibutyl terephthalate, dibenzyl terephthalate, dibutyl isophthalate, 1-hydroxynaphthoic acid phenyl ester, benzyl 4-methylthiophenyl ether, p-benzylbiphenyl, and various known heat-fusible substances, etc.

Among these sensitizing agents, preferred are 1,2-bis(3-methylphenoxy)ethane, 1,2-diphenoxyethane, 1-phenoxy-2-(4-methylphenoxy)ethane and benzyl 4-methylthiophenyl ether, because they give a high sensitizing effect.

The amount of the sensitizing agent to be used is not specifically limited, but it is usually about 400 parts by weight or less per 100 parts by weight of the color developing material.

The recording layer as well as the protective layer of the heat-sensitive recording material in the invention can be formed by methods selected without specific limitation as by applying the coating composition to a base sheet by air knife coating, bar coating, varibar blade coating, pure blade coating, short dwell coating, curtain coating or other suitable methods, and drying the thus-formed coating layer. The amount of the coating composition to be applied is not specifically limited and is generally about 2 to about 12 g/m$^2$, preferably about 3 to about 10 g/m$^2$ on dry basis.

Examples of supports or base sheets on which the recording layer is formed are paper, plastics films, synthetic paper and the like among which paper is most preferred in terms of costs and suitability for coating.

When required, the protective layer can be formed on the rear side of the heat-sensitive recording material to enhance the stability of the record images. Other techniques used in the prior art for production of heat-sensitive recording materials can be employed if necessary and include, for example, application of undercoats on supports, application of an adhesive on the rear side of recording material to obtain an adhesive label, etc.

EXAMPLES

The present invention will be described below in greater detail with reference to the following examples to which the scope of the invention is not limited. In the following examples, "parts" and "percentages" are all by weight unless otherwise specified.

EXAMPLE 1

(1) Preparation of Dispersion A

| | |
|---|---|
| 3-(N-ethyl-N-isoamyl)amino-6-methyl-7-phenylaminofluoran | 10 parts |
| 5% Aqueous solution of methyl cellulose | 5 parts |
| Water | 40 parts |

The mixture of the above components was pulverized by a sand mill to a mean particle size of 2 μm.

(2) Preparation of Dispersion B

| | |
|---|---|
| 4,4'-isopropylidenediphenol | 30 parts |
| 5% Aqueous solution of methyl cellulose | 5 parts |
| Water | 80 parts |

The mixture of these components was pulverized by a sand mill to a mean particle size of 2 μm.

(3) Preparation of Dispersion C

| | |
|---|---|
| 1,2-bis(3-methylphenoxy)ethane | 20 parts |
| 5% Aqueous solution of methyl cellulose | 5 parts |
| Water | 55 parts |

The mixture of these ingredients was pulverized by a sand mill to a mean particle size of 2 μm.

(4) Formation of recording layer

A 55 part quantity of Dispersion A, 115 parts of Dispersion B, 80 parts of Dispersion C, 80 parts of 10% aqueous solution of polyvinyl alcohol and 35 parts of calcium carbonate were mixed together with stirring, giving a coating composition. The coating composition obtained was applied by a bar coater to a base paper weighing 50 g/m$^2$ in an amount of 6 g/m$^2$ on dry basis and then dried to produce a heat-sensitive recording material.

(5) Preparation of coating composition for protective layer

| | |
|---|---|
| 10% Aqueous solution of acetoacetyl group-modified polyvinyl alcohol (saponification degree = 95 mole %, polymerization degree = 1000, content of modified vinyl alcohol units = 3 mole %) | 200 parts |
| Calcium carbonate | 100 parts |
| Aqueous emulsion of zinc stearate (concentration of 30%) | 20 parts |
| Aqueous solution of calcium acetate (concentration of 5%) | 5 parts |
| Water | 200 parts |

These components were mixed together until a homogeneous mixture was obtained.

(6) Formation of protective layer

The coating composition for protective layer obtained above was applied by a bar coater to the foregoing heat-sensitive recording layer in an amount of 6 g/m$^2$ on dry basis and then dried to obtain a heat-sensitive recording material having a protective layer.

EXAMPLE 2

A heat-sensitive recording material was produced in the same manner as in Example 1 with the exception of using, in preparation of Dispersion B, 4-hydroxy-4'-isopropyloxydiphenylsulfone in place of 4,4'-isopropylidenediphenol.

EXAMPLE 3

A heat-sensitive recording material was obtained in the same manner as in Example 2 with the exception of using, in preparation of the coating composition for protective layer, magnesium acetate in place of calcium acetate.

EXAMPLE 4

A heat-sensitive recording material was prepared by the same procedure as in Example 2 with the exception of using, in preparation of the coating composition for protective layer, aluminum acetate in lieu of calcium acetate.

EXAMPLE 5

A heat-sensitive recording material was prepared in the same manner as in Example 2 with the exception of using, in preparation of the coating composition for protective layer, calcium formate in place of calcium acetate.

EXAMPLE 6

A heat-sensitive recording material was produced in the same manner as in Example 2 with the exception of using, in preparation of the coating composition for protective layer, aluminum formate in lieu of calcium acetate.

EXAMPLE 7

A heat-sensitive recording material was obtained in the same manner as in Example 2 with the exception of using, in preparation of the coating composition for protective layer, magnesium formate in place of calcium acetate.

EXAMPLE 8

A heat-sensitive recording material was produced by the same procedure as in Example 2 with the exception of using, in preparation of the coating composition for protective layer, carboxyl group-modified polyvinyl alcohol prepared by saponifying a copolymer of vinyl acetate and itaconic acid (saponification degree: 95 mole %, polymerization degree: 1000, content of carboxyl group-modified units: 3 mole %) in place of acetoacetyl group-modified polyvinyl alcohol.

EXAMPLE 9

A heat-sensitive recording material was prepared in the same manner as in Example 2 with the exception of using, in preparation of the coating composition for protective layer, silicon-modified polyvinyl alcohol prepared by saponifying a copolymer of vinyl acetate and vinyltrimethoxysilane (saponification degree: 95 mole %, polymerization degree: 1000, content of Si-containing units: 3 mole %) in place of the acetoacetyl group-modified polyvinyl alcohol.

EXAMPLE 10

A heat-sensitive recording material having a protective layer was prepared in the same manner as in Example 2 with the exception of using, in preparation of the coating composition for protective layer, 40 parts of an aqueous solution of calcium acetate (concentration of 5%) and further using 170 parts of water.

EXAMPLE 11

A heat-sensitive recording material having a protective layer was prepared in the same manner as in Example 2 with the exception of using, in preparation of the coating composition for protective layer, 200 parts of 10% aqueous solution of polyvinyl alcohol (saponification degree=95 mole %, polymerization degree=1000) in place of an aqueous solution of acetoacetyl group-modified polyvinyl alcohol.

EXAMPLE 12

A heat-sensitive recording material having a protective layer was prepared in the same manner as in Example 2 with the exception of using, in preparation of the coating composition for protective layer, 200 parts of 10% aqueous solution of polyvinyl alcohol (saponification degree=88 mole %, polymerization degree=1000) in place of an aqueous solution of acetoacetyl group-modified polyvinyl alcohol.

EXAMPLE 13

A heat-sensitive recording material having a protective layer was prepared in the same manner as in Example 2 with the exception of adding, in preparation of the coating composition for protective layer, 0.25 part of 40% aqueous solution of glyoxal.

COMPARATIVE EXAMPLE 1

A heat-sensitive recoring material was obtained by the same procedure as in Example 1 except that calcium acetate was not used in preparation of the coating composition for protective layer.

COMPARATIVE EXAMPLE 2

A heat-sensitive recording material was prepared in the same manner as in Example 2 except that calcium acetate was not used in preparation of the coating composition for protective layer.

COMPARATIVE EXAMPLE 3

The same procedure as in Example 8 was repeated without using calcium acetate in preparation of the coating composition for protective layer to produce a heat-sensitive recording material.

COMPARATIVE EXAMPLE 4

A heat-sensitive recording material was obtained in the same manner as in Example 9 except that calcium acetate was not used in preparation of the coating composition for protective layer.

COMPARATIVE EXAMPLE 5

The same procedure as in Example 2 was repeated with the exception of using, in preparation of the coating composition for protective layer, aluminum sulfate in place of calcium acetate, giving a heat-sensitive recording material.

COMPARATIVE EXAMPLE 6

A heat-sensitive recording material was produced by the same procedure as in Example 2 with the exception of using, in preparation of the coating composition for protective layer, aluminum chloride in lieu of calcium acetate.

COMPARATIVE EXAMPLE 7

The same procedure as in Example 2 was repeated with the exception of using, in preparation of the coating composition for protective layer, sodium acetate in place of calcium acetate.

COMPARATIVE EXAMPLE 8

A heat-sensitive recording material having a protective layer was produced by the same procedure as in Comparative Example 5 with the exception of adding, in preparation of the coating composition for protective layer, 0.25 part of 40% aqueous solution of glyoxal.

Each of the 21 kinds of heat-sensitive recording materials obtained above was evaluated for whiteness, developed color density, water resistance, plasticizer resistance, water-plasticizer resistance and sticking. Table 1 shows the results.

Whiteness:

The whiteness of the recording layer of the heat-sensitive recording material was determined by a Hunter multi-purpose reflectmeter.

Developed color density:

The developed color density of recorded images formed with use of a thermal printer (Model PC-100A, manufactured by Texas Instruments Co., Ltd.) was measured by a Macbeth densitometer (Model RD-100R, manufactured by Macbeth Corp.).

Water resistance:

A heat-sensitive recording material on which images were formed was immersed in water for 15 hours and withdrawn. The image portion of the recording material was rubbed with a fingertip to achieve 5 strokes. The change of developed color density of the image was obserbed with the unaided eye, whereby the recording material was evaluated for water resistance.

Plasticizer resistance:

A polyvinyl chloride wrap film (product of Mitsui Toatsu Chemicals, Inc.) was wound three-fold around a polypropylene pipe (40 mmΦ). A heat-sensitive recording material having formed images was superposed on the film with the images directed outward and thereon was further wound a polyvinyl chloride-wrap film three-fold. After standing at 40° C. for 15 hours, the change of developed color density of the images was obserbed, whereby the recording material was assessed for plasticizer resistance.

Water-plasticizer resistance:

A heat-sensitive recording material after recording was lightly moistened with water and then tested in the same manner as in the evaluation for plasticizer resistance as described above, whereby the recording material was evaluated for water-plasticizer resistance.

The heat-sensitive recording materials were evaluated for water resistance, plasticizer resistance and water-plasticizer resistance according to the following criteria:

A: Little or no reduction in developed color density

B: Slightly reduced in developed color density but encountering substantially no problem in use C: Reduced in developed color density and encountering a problem in use D: Significantly reduced in developed color density and impossible to use.

Sticking:

While images were formed on each of the heat-sensitive recording materials with use of a thermal printer, the recording material was assessed for sticking according to the following criteria.

A: No problem in use

C: Encountering a little problem in use.

TABLE 1

| | Whiteness | Developed color density | Water resistance | Plasticizer resistance | Water-plasticizer resistance | Sticking |
|---|---|---|---|---|---|---|
| Example 1 | 80.9 | 1.15 | B | B | B | A |
| Example 2 | 82.4 | 1.12 | B | A | B | A |
| Example 3 | 82.2 | 1.13 | B | A | B | A |
| Example 4 | 82.1 | 1.12 | B | A | B | A |
| Example 5 | 82.1 | 1.12 | B | A | B | A |
| Example 6 | 82.5 | 1.13 | B | A | B | A |
| Example 7 | 82.3 | 1.13 | B | A | B | A |
| Example 8 | 82.1 | 1.12 | B | A | B | A |
| Example 9 | 82.0 | 1.12 | B | A | B | A |
| Example 10 | 82.0 | 1.10 | B | A | B | A |
| Example 11 | 82.0 | 1.10 | B | B | B | A |
| Example 12 | 82.1 | 1.11 | B | B | B | A |
| Example 13 | 82.1 | 1.10 | A | A | B | A |
| Comp. Ex. 1 | 80.8 | 1.14 | C | C | C | C |
| Comp. Ex. 2 | 82.4 | 1.13 | C | B | C | C |
| Comp. Ex. 3 | 82.2 | 1.12 | C | B | C | C |
| Comp. Ex. 4 | 82.2 | 1.12 | C | B | C | C |
| Comp. Ex. 5 | 75.2 | 1.10 | B | B | C | A |
| Comp. Ex. 6 | 76.2 | 1.12 | B | B | C | A |
| Comp. Ex. 7 | 82.2 | 1.12 | C | B | C | A |
| Comp. Ex. 8 | 74.0 | 1.10 | A | B | C | A |

The results in Table 1 reveal that the heat-sensitive recording materials of the present invention are excellent ones which exhibit outstanding retentivity of the images recorded thereon, which are free of the troubles such as sticking and the like and which are not impaired in whiteness and developed color density.

We claim:

1. A heat-sensitive recording material comprising:

(a) a base sheet;

(b) a heat-sensitive recording layer formed on the base sheet and comprising a colorless or pale-colored basic dye and a color developing material which develops a color on contaẽt with the dye; and (c) a protective layer formed on the recording layer and comprising a binder and at least one metal salt selected from the group consisting of magnesium acetate, calcium acetate, aluminum acetate, magnesium formate, calcium formate and aluminum formate.

2. A heat-sensitive recording material as defined in claim 1 wherein the binder is at least one member selected from the group consisting of starches, hydroxyethyl cellulose, methyl cellulose, carboxymethyl cellulose, gelatin, casein, gum arabic, polyvinyl alcohol, carboxyl group-modified polyvinyl alcohol, acetoacetyl group-modified polyvinyl alcohol, silicon-modified polyvinyl alcohol, salts of diisobutylene-maleic anhydride copolymer, salts of styrene-maleic anhydride copolymer, salts of ethylene-acrylic acid copolymer and salts of styrene-acrylic acid copolymer.

3. A heat-sensitive recording material as defined in claim 1 wherein the binder is at least one member selected from the group consisting of polyvinyl alcohol, carboxyl group-modified polyvinyl alcohol, acetoacetyl group-modified polyvinyl alcohol and silicon-modified polyvinyl alcohol.

4. A heat-sensitive recording material as defined in claim 1 wherein the binder is at least one member selected from the group consisting of carboxyl group-modified polyvinyl alcohol, acetoacetyl group-modified polyvinyl alcohol and silicon-modified polyvinyl alcohol.

5. A heat-sensitive recording material as defined in claim 1 wherein the metal salt is used in an amount of about 0.1 to about 30 parts by weight per 100 parts by weight of the binder.

6. A heat-sensitive recording material as defined in claim 5 wherein the metal salt is used in an amount of about 0.5 to about 20 parts by weight per 100 parts by weight of the binder.

7. A heat-sensitive recording material as defined in claim 5 wherein the metal salt is used in an amount of about 0.5 to about 10 parts by weight per 100 parts by weight of the binder.

8. A heat-sensitive recording material as defined in claim 1 wherein a curing agent is further added to the protective layer.

9. A heat-sensitive recording material as defined in claim 8 wherein the curing agent is used in an amount of about 0.001 to about 100 parts by weight per 100 parts by weight of the binder.

10. A heat-sensitive recording material as defined in claim 1 wherein the protective layer further contains a pigment.

11. A heat-sensitive recording material as defined in claim 10 wherein the pigment is used in an amount of about 5 to about 1,000 parts by weight per 100 parts by weight of the binder.

12. A heat-sensitive recording material as defined in claim 1 wherein the protective layer is formed by applying to the heat-sensitive recording layer a coating composition comprising the binder and at least one of the metal salts, wherein the amount of the coating composition to be applied is about 0.1 to about 20 $g/m^2$ on dry basis.

* * * * *